United States Patent [19]

Colacci

[11] Patent Number: 4,491,159

[45] Date of Patent: Jan. 1, 1985

[54] HIGH SPEED LIQUID DISPENSER

[75] Inventor: John R. Colacci, Pennsauken, N.J.

[73] Assignee: Campbell Soup Company, Camden, N.J.

[21] Appl. No.: 491,090

[22] Filed: May 3, 1983

[51] Int. Cl.[3] ..... B65B 57/02; B65B 43/42

[52] U.S. Cl. ..... 141/134; 141/140; 141/144; 141/183; 141/392

[58] Field of Search ..... 141/129, 131-135, 141/138, 140, 144, 163, 177, 181-183, 192, 234, 236, 387, 392; 222/485; 239/548, 558, 562

[56] References Cited

U.S. PATENT DOCUMENTS

| | | | |
|---|---|---|---|
| 2,588,483 | 3/1952 | Chapman | 141/134 |
| 3,055,404 | 9/1962 | Anderson | 141/144 |
| 3,570,557 | 3/1971 | Mollins | 141/129 X |

FOREIGN PATENT DOCUMENTS

| | | | |
|---|---|---|---|
| 632002 | 12/1961 | Canada | 141/131 |

*Primary Examiner*—Stephen Marcus

*Assistant Examiner*—Ernest G. Cusick

*Attorney, Agent, or Firm*—Albert L. Free

[57] ABSTRACT

Apparatus for dispensing squirts of liquid into the top openings of a moving train of regularly spaced-apart containers, including a rotating circular band having a plurality of nozzle openings spaced about it and aligned directly over the container top openings, and a fixed manifold device slidingly sealed to the band and supplied with liquid under pressure so that each time a nozzle opening passes the manifold it supplies a squirt of liquid into a corresponding container moving along beneath it. Automatic shut-off of the dispenser is provided in the absence of a container by sensing the absence of the container at an upstream position and automatically moving the manifold device axially out of alignment with the path of the nozzle openings to prevent squirting of liquid into a gap in the train. Another manifold slidingly sealed to the band is supplied with pressurized air so that each nozzle is blown clean of liquid immediately after it completes its dispensing action.

12 Claims, 8 Drawing Figures

3
10
26
17
66
120
118
68
64
26
20
140
142
134
32b
136
18
16
30
108
90
26
12
12
12
110
112
106
3

HIGH SPEED LIQUID DISPENSER

This invention relates to method and apparatus for the high-speed dispensing of liquids, and especially for such dispensing of measured quantities of liquid into each of a train of open-topped containers as they move rapidly past a dispensing station.

BACKGROUND OF THE INVENTION

There are many applications in which it is desirable to dispense predetermined amounts of liquid into liquid containers. This is true, for example, in the food industry, wherein cans are often to be filled with food product or the like in liquid form and in a predetermined amount. One type of such substance, for example, comprises liquid butter fats to be added to food containers such as food cans in predetermined amounts.

In efficient mass production it is of course also desirable to dispense the liquid material as rapidly as possible, and in the case of production-line operations to dispense it fast enough to keep up with the desired speed of containers along the line.

One way in which liquid product might be dispensed into a container in a train of similar open-topped containers would be to advance the containers stepwise through stationary positions beneath a dispensing nozzle, and to turn each nozzle on sufficiently long to dispense the desired amount of liquid product while the container is stationary beneath it. Such starting and stopping of the line is undesirable, however, because in the long run it requires more time and more complicated equipment, and produces greater wear on the equipment and a certain amount of sloshing of the contents of the containers during abrupt starts and stops. Thus for many purposes such an approach is infeasible, or at least highly impractical.

Another approach is to allow the open-topped containers to move continuously at a relatively high speed in a sequential train beneath a liquid dispensing nozzle, and to turn on the nozzle as each can or container passes beneath it. While such an arrangement is feasible for many purposes, it does suffer from the drawback that, to avoid wastage or spillage of the liquid material, the maximum time interval during which the liquid can be dispensed is the time required for the container to move by a distance equal to the diameter of its top opening, and since the stream being dispensed will normally have an appreciable width along the direction or motion of the container, the permissible time interval for dispensing is even somewhat shorter than that. As the speed of the container increases, for example to speeds on the order of 600 containers per minute, or 10 a second, the times available for dispensing would typically be less than 1/20 of a second for each container, and it will therefore readily be appreciated that it is often difficult to provide squirts of liquid of the desired volume in such short time periods.

It is also desirable to inhibit the dispensing of the liquid should a container, on occasion, be missing from its expected position in the train of containers.

Accordingly, it is an object of the present invention to provide a method and apparatus for the high speed dispensing of liquids.

Another object is to provide such high-speed dispensing at accurately controlled times, and for accurately controlled time intervals, in predetermined amounts.

Another object is to provide apparatus suitable for such purposes which is relatively inexpensive to provide and operate, clean and easy to maintain, and relatively compact in structure.

A further object is to provide such method and apparatus which are capable of dispensing desired quantities of liquid through the open tops of containers continuously moving at a high rate of speed adjacent the dispensing unit.

Still another object is to provide the latter method and apparatus which are capable of dispensing a greater amount of liquid into an open-topped container for a given speed of the container past the dispenser than has heretofore been possible.

It is also an object to assure that the liquid is not dispensed when no container is in position to receive it.

BRIEF SUMMARY OF THE INVENTION

In accordance with the invention, these and other objects and features are achieved by the provision of method and apparatus for dispensing a liquid into open-topped containers moving in a train along a predetermined path, by rotating a plurality of liquid-dispensing nozzle openings about an axis transverse to the container path, so that the successive nozzle openings, when moving along the bottom portion of the arc of their motion, are positioned over, and for a time move along with, the containers. Liquid dispensed from a given nozzle opening can thereby be caused to enter the top of the corresponding container for a longer period of time than if the nozzle opening were stationary and the container moving past at the same rate. For a given amount of liquid material to be dispensed into the containers, this arrangement therefore permits a high rate of movement of the containers past the dispenser, and improved production efficiency.

Preferably the nozzle openings are equally spaced around the circumference of a flat circular band mounted for rotation about a horizontal central axis normal to the path of the containers, and the desired sequential supply of liquid to the nozzles is provided by the use of a pressure shoe which is fixable in position with respect to the band when dispensing is desired and having a liquid-manifolding recess in a surface thereof, the periphery of the recess bearing sealingly against the surface of the band so that, as the band rotates about the axis, successive nozzle openings traverse and communicate with the recess and are supplied with the liquid product under pressure in the recess during each such traversal. By appropriate adjustment of the speed of rotation and the phase of rotation of the band, each nozzle opening can then be caused to eject the desired spurt of liquid during the appropriate angular distance of its rotation above the tops of the train of cans, so as to dispense liquid into the appropriate corresponding container only. Preferably the circumference of the band, the number of nozzles, and the speed of rotation of the band are selected so that the horizontal speed of each nozzle when oriented directly downwardly is substantially the same as the speed of the corresponding can.

In a preferred form of the invention, the apparatus is provided with liquid flow shut-off means for moving the pressure shoe axially with respect to the band, to and from a shut-off position in which the nozzle openings do not communicate with the recess. Preferably this motion of the shut-off means is provided in response to a control signal generated by the absence of a container from its intended position in the train of containers; when such an absence occurs, the shifting of the axial position of the shoe at the appropriate time prevents dispensing of the liquid into a gap in the train of containers.

There are preferably also provided pump means synchronized with the rotation of the band for delivering a flow of the liquid to the recess in the shoe whenever the liquid is to be dispensed through one of the nozzle openings, a diversion line for diverting flow of liquid into the diversion line when the shut-off means blocks the flow to and through a nozzle opening, and valve means for connecting the pump output to the diversion line only when the liquid flow to the manifolding-recess is blocked by operation of the shut-off means. In this way a positive displacement pump normally supplying the liquid to the nozzle openings can operate safely in its appropriate cycle even when the nozzle openings are blocked by operation of the shut-off means, the liquid then being discharged instead through the valve and the diversion line to a suitable storage container.

Also, in a preferred embodiment of the invention the shoe means is provided with an additional air blow-out recess sealed slidingly to the rotating band and positioned so as to become aligned with each nozzle opening shortly after each nozzle opening has ceased communication with the liquid manifolding recess. The air blow-out recess is preferably supplied continuously with air under pressure, whereby each nozzle, after it has terminated its dispensing action, is blown out with air to remove therefrom droplets of liquid, preferably blowing them into the container, thereby to eliminate dripping from the nozzle openings as they move around the band between successive dispensing positions.

BRIEF DESCRIPTION OF FIGURES

These and other objects and features of the invention will be more readily understood from a consideration of the following detailed description, taken with the accompanying drawings, in which.

DETAILED DESCRIPTION OF SPECIFIC EMBODIMENTS

Figure 1:
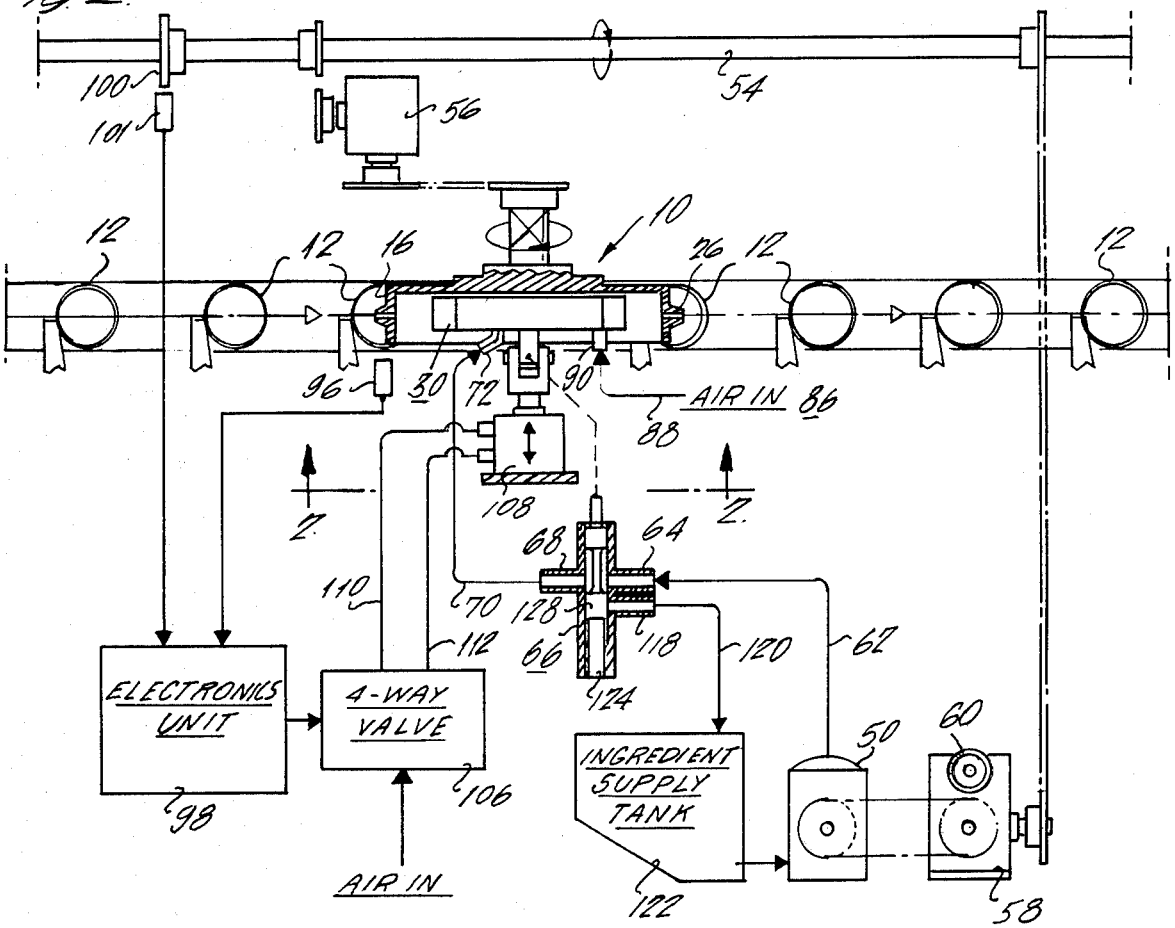
FIG. 1 is a schematic plan view of a system embodying the invention.
Figure 6:
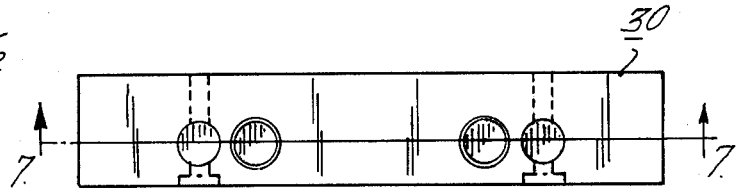
FIG. 6 is an enlarged plan view of the dispensing shoe of FIGS. 1–5.

Turning now to the embodiment of the invention shown in the drawings by way of example only, and without thereby in any way limiting the scope of the invention, FIG. 1 shows a liquid dispensing station 10 beneath which containers such as 12 pass in a sequential train, preferably equally spaced from each other and moving at a steady high speed. Each of the containers such as 12 is open-topped, and is to be supplied with a predetermined amount of liquid material, such as liquid butterfat for example.

Above the path of the containers 12 there is mounted a rotatable band 16 which is circular and rotatable on and about a fixed central axle 18 (see FIG. 3) within a fixed housing 17. The latter axle is in this example horizontal, and extends at right angles to the direction of movement of the containers beneath it. The band is aligned with the path of the containers so that the band rotates directly above and along the centers of the open-topped containers.

In this example the band 16 is integral with a plate 20 serving as a web to support the band for rotation about the axle 18. The band and the plate, taken together, constitute in effect an integral open-ended drum, rotatable about said axle.

Figure 4:
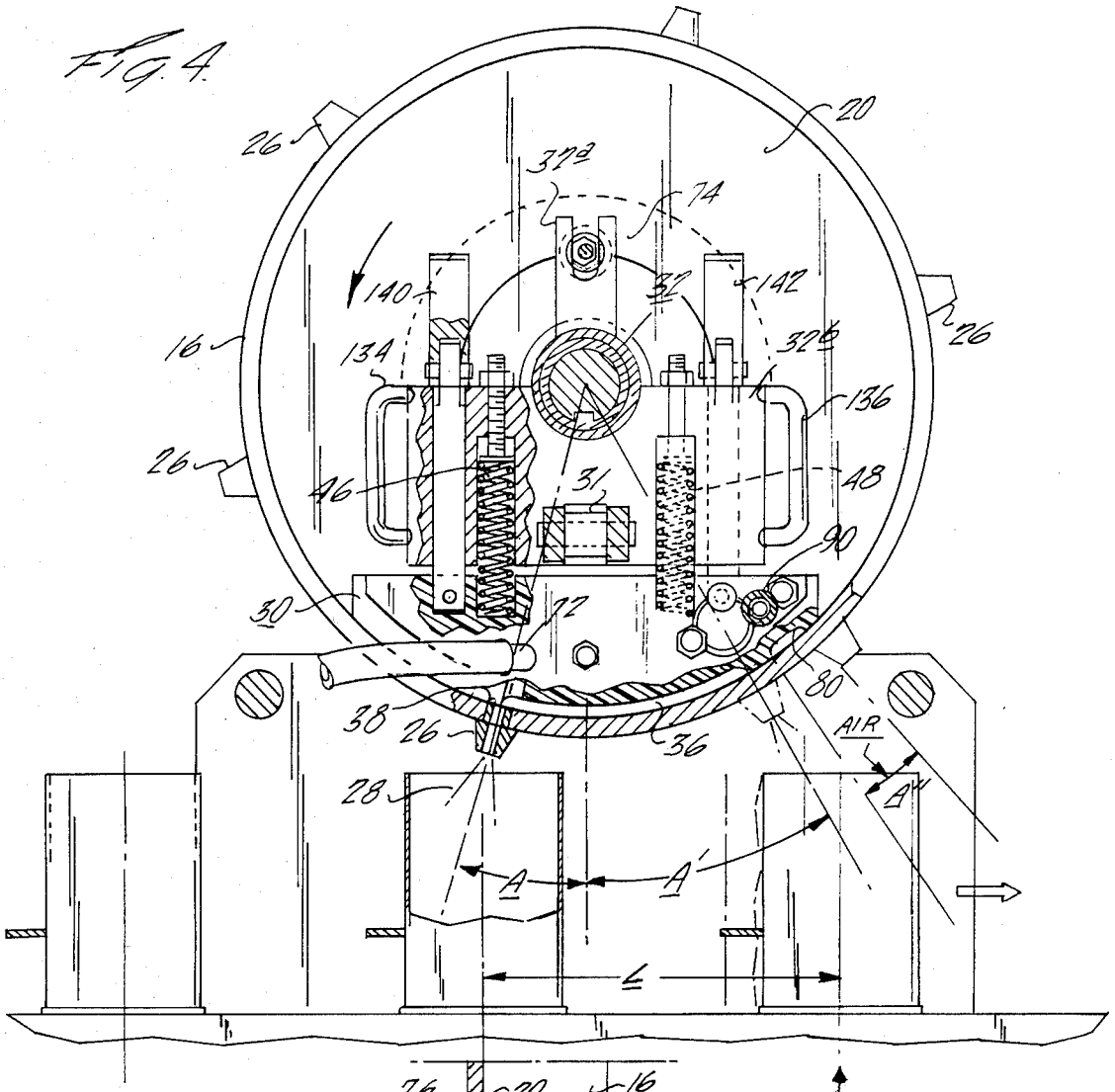
FIG. 4 is a fragmentary sectional view, in elevation, taken on lines 4—4 of FIG. 3.

Around the circumferential periphery of the band 16 are disposed six equally spaced-apart nozzle openings such as 26, so located axially that they rotate directly over the centers of the containers 12 and along the direction of motion thereof. As shown in FIG. 4, the system then operates so that as each container passes below the dispensing unit, one of the nozzle openings travels along and above it, typically delivering a stream of liquid such as 28 to a container beginning at a time for which the stream from the nozzle is at an angle A with respect to the vertical, and terminating when the stream is at an angle A′ on the opposite side of the vertical; typically, angle A may be about 15° and angle A′ about 30°, for a total of 45° during which liquid dispensing occurs. The next nozzle opening on the band then dispenses liquid into the top of the next container, and so on as the band continues to rotate in synchronism with the passage of containers beneath it. Since the nozzle is travelling near the can speed when dispensing the liquid, the stream also moves horizontally at this speed and hence is better able to reach its desired target area in the can.

Figure 5:
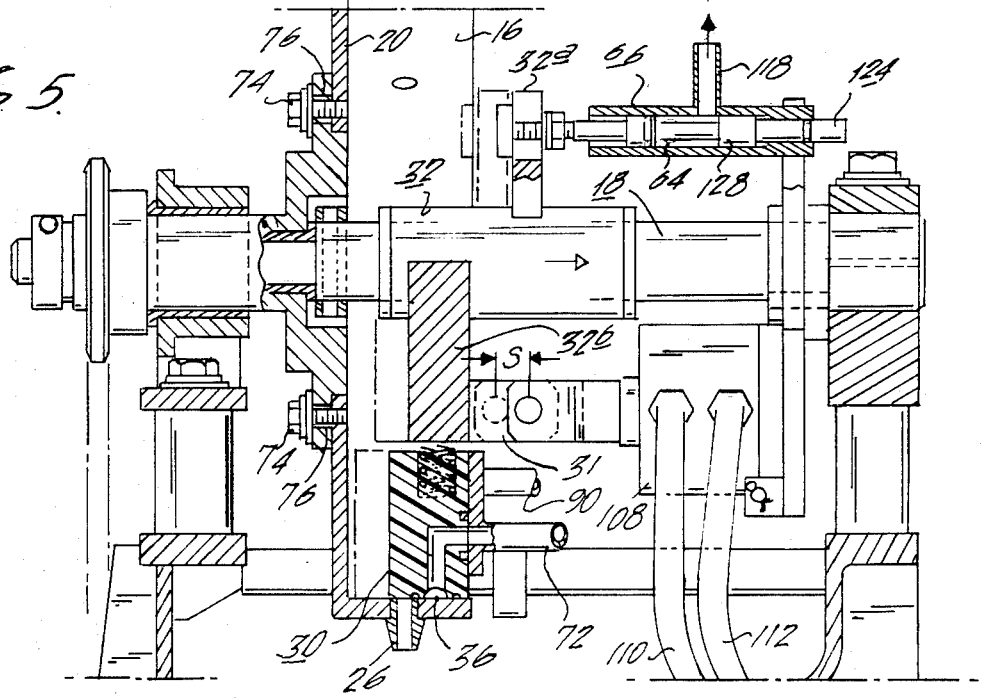
FIG. 5 is a fragmentary sectional view, in elevation, similar to FIG. 3 but showing it in the shut-off condition in which liquid dispensing is blocked.

To deliver liquid to each of the nozzle openings in succession, there is provided a shoe 30, which shoe is axially slideable. Shoe 30 is normally fixed in the axial position shown, but is moved axially from this position in order to shut off the delivery of liquid to the nozzle openings, as shown in FIG. 5 and as described hereinafter.

As shown particularly clearly in FIGS. 6–8, and FIGS. 3, 4 and 5, the shoe 30 contains a chamber or recess 36 extending inward from its outer surface which serves as a liquid manifold and temporary storage chamber for the liquid to be dispensed. Around the periphery of the manifolding recess 36 there is provided a resilient gasket 38 which bears against the interior side of the band 16. Shoe 30 (FIG. 3) is fixed against rotation about axle 18 by key 42, and is urged against the inner side of the band 16 by the helical spring members 46 and 48 (FIG. 4) so as to insure the desired liquid seal about the periphery of the liquid manifolding recess 36.

As shown in FIG. 1, liquid to be dispensed is continuously supplied by a positive-displacement rotary pump 50, the drive for which is coordinated with rotation of the band and with the travel of the containers along their predetermined path. Preferably this is accomplished by utilizing a common motive source, such as the can-closure rotating shaft 54 and appropriate conventional gearing 56 to maintain the above-described speed relationships for the pump, container conveyor and dispenser. To adjust the quantity of liquid dispensed into each can, there is preferably employed a variable speed device 58 having a manual adjustment 60 for changing the speed of operation of the pump for a given speed of the gears which drive it.

The output of the positive displacement pump 50 is connected through tubing 62 to an inlet fitting 64 on spool valve 66, an outlet opening 68 of which is connected through tubing 70 to the liquid inlet fitting 72 of shoe 30. The latter fitting communicates with the manifolding recess 36 of the shoe, so that a substantially constant pressure of liquid is maintained in the recess. In this way a predetermined controlled amount of the liquid is dispensed into each container as each nozzle opening traverses the angle of the shoe occupied by the recess.

With this arrangement, the pump has an amount of time to dispense the liquid product which is equal to the time for the nozzle opening and band to rotate through the sum of the angles A and A′ (FIG. 4), which is the same time as that required for each container to move through a distance L along its path. It is noted that the distance L is substantially greater than the diameter of a container, so that time available for the present system to fill a rapidly-moving container with a predetermined amount of liquid is very substantially greater than in a system in which a stationary, downwardly-pointing nozzle dispenses liquid only during the time of travel of the container by a distance equal to one diameter of the container, as in the prior art.

Figure 3:
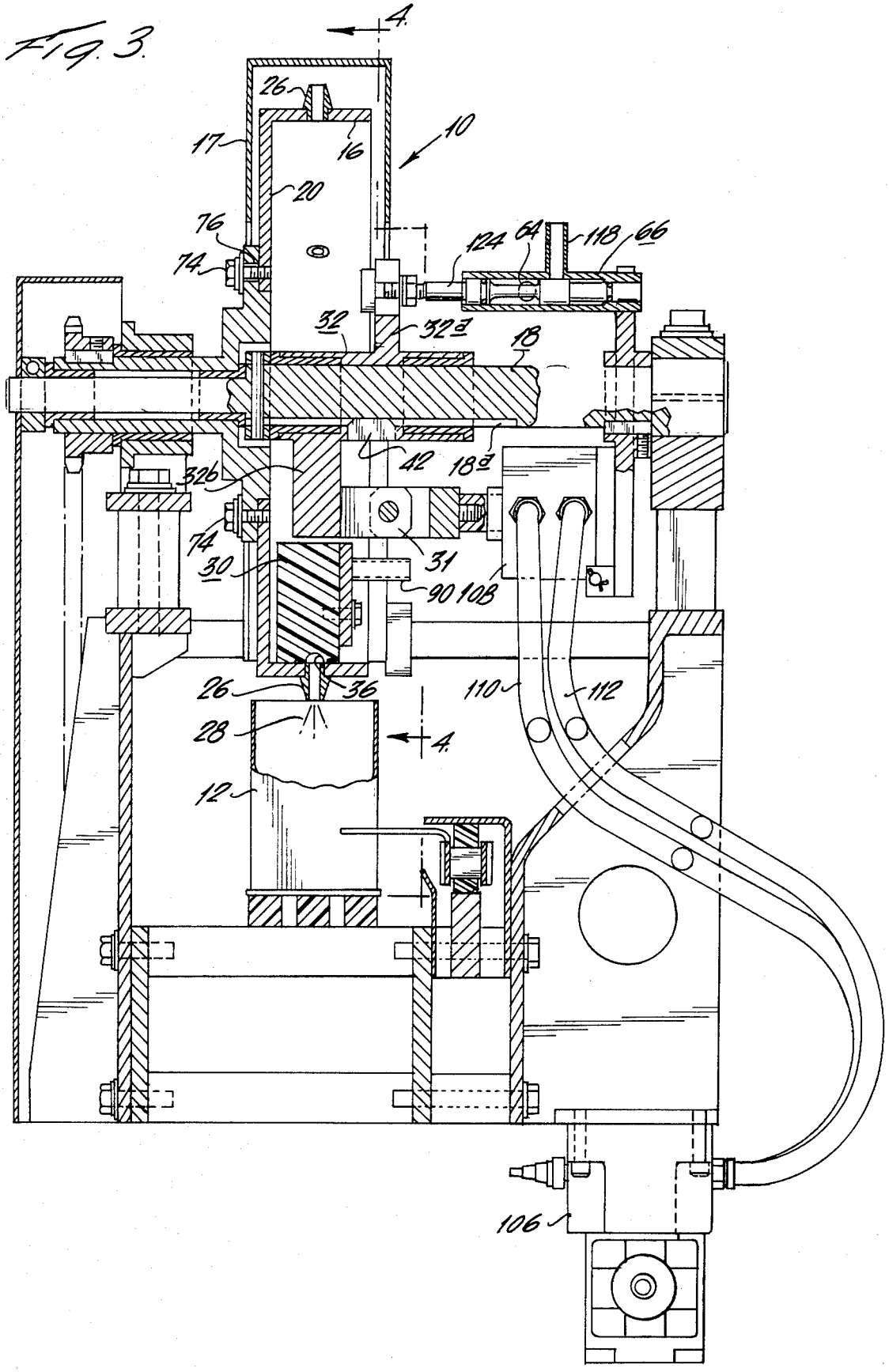
FIG. 3 is a sectional elevational view taken on lines 3—3 of FIG. 2.

Referring to FIGS. 3–5, to permit adjustment of the phase of rotation at which dispensing occurs, plate 20 is mounted by three bolts such as 74 extending through hub slots such as 76, into any selected three of six tapped holes in the plate 20, so that when the bolts are loosened the plate 20 and the band 16 can be turned to adjust the phase of dispensing and the bolts then replaced in the appropriate holes and tightened.

Figure 7:
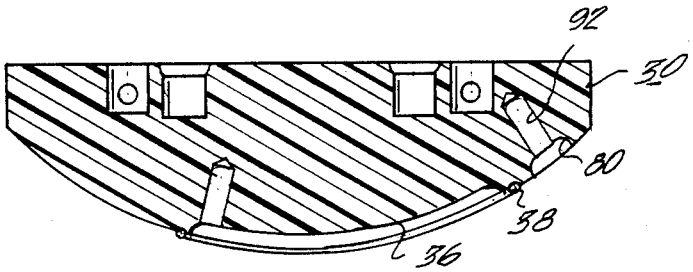
FIG. 7 is a sectional elevational view of the shoe of FIG. 6, taken on lines 7—7.
Figure 8:
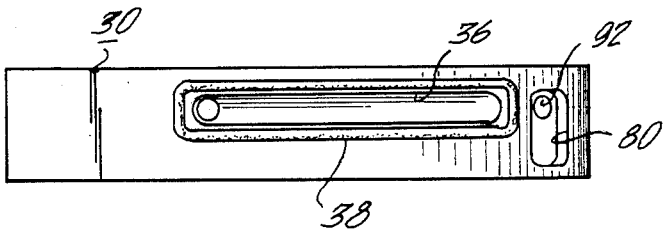
FIG. 8 is a bottom plan view of the shoe.
Figure 2:
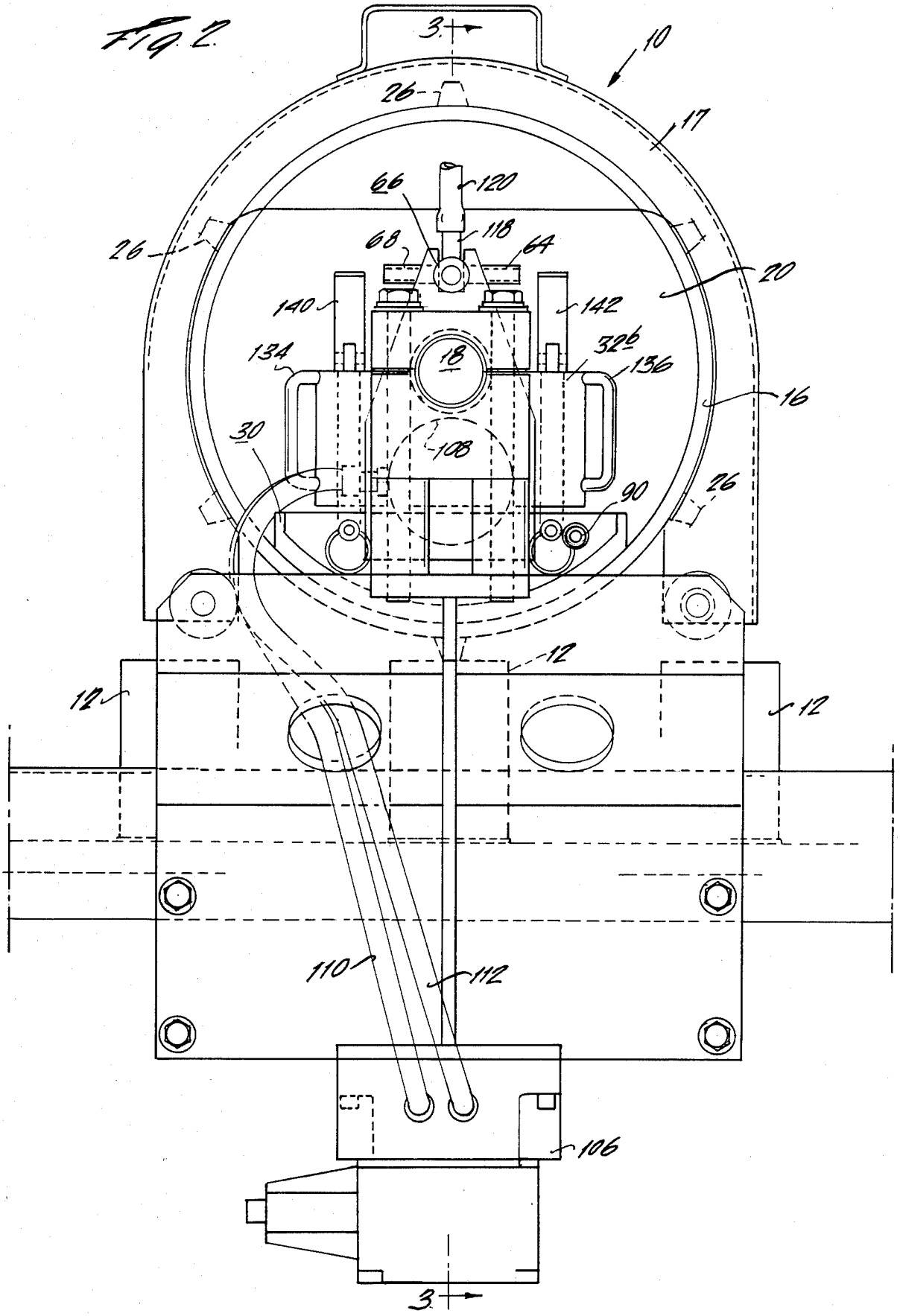
FIG. 2 is an enlarged front elevational view taken along lines 2—2 in FIG. 1.

As shown particularly clearly in FIGS. 4, 7 and 8, there is preferably also provided an air blow-out recess 80 in the surface of shoe 30, the recess being positioned just beyond the manifold recess 36 as shown. A source 86 of air under pressure is connected through tubing 88 to an inlet fitting 90 on shoe 30, and is connected interiorly of the shoe through interior passage 92 to air blow-out recess 80. With this arrangement, air under pressure is constantly being applied to recess 80, and for most of the cycle of rotation of band 16 this air pressure is blocked by band 16; however, each time a nozzle traverses the air blow-out recess 80, a blast of air is delivered through that nozzle to clear out remaining droplets of liquid which may be clinging thereto. Preferably this is done during the last portion of the time during which the nozzle is aligned with the open top of its corresponding container, i.e. during the traversal of the angle A″, so that blow-out through the nozzle delivers the blown-out material primarily into the container rather than into the adjacent ambient.

Also preferably provided is a NO-CAN detector 96, positioned along the path of the containers just upstream of the dispensing station (see FIG. 1). Such devices are now well known in the art and need not be described in detail, in this case comprising a commercial metal detector producing an electrical output signal indicative of whether a metal container is passing the detector or not. The purpose of this detector is to prevent the dispenser from dispensing liquid into an empty gap between containers when a container is missing from the train for any reason.

To accomplish this, the signal from the NO-CAN detector is supplied to a conventional electronics unit 98 which is also supplied with signals from a shaft-angle pickoff disc 100 on shaft 54, which rotates in synchronism with the rate of delivery of containers by the conveyor, i.e. at a rate of one cycle per container. A shaft-angle pickoff member 101 is angularly positioned to produce an electrical output signal at a pre-set angular position of pick-off disc 100, preferably at, or very slightly before, the time when the corresponding nozzle opening would begin to dispense liquid into the empty gap created by the absence of the container. The electronics unit 98 performs an AND function and operates four-way valve 106 only when the metal-detector signal indicative of the absence of a container and the shaft-pickoff signal occur contemporaneously. Operation of the four-way valve 106 then applies pressure to the air cylinder 108 by way of hoses 110 and 112 to suddenly drive the shoe 30 axially to its outer position in which the nozzle openings are no longer in circumferential alignment with the liquid-manifolding recess 36, and hence dispensing is inhibited; air blow-out recess is sufficiently wide axially to retain communication with the nozzle openings even during this shut-off of the liquid dispensing action. When the metal detector senses the next container, the electronics unit operates the four-way valve to drive the shoe 30 rapidly back to its normal axial position, as desired.

When the shut-off mechanism has moved the shoe axially to block the dispensing of liquid through the nozzle openings, it is highly desirable to provide an alternate path for the liquid during operation of the positive-displacement pump. Accordingly, spool valve 66 is provided with a relief or liquid-diversion outlet port 118 connected through hose 120 to storage container 122. The spool 124 of valve 66 is mechanically connected directly to the shoe support mechanism, so that when shoe 30 is moved axially during the NO-CAN shut-off operation, spool 124 is positively driven in the same direction, whereby land 128 of the spool uncovers port 118 and permits liquid flow out of port 118 to relieve the pressure created by the pump at such times. As shown, the normal outlet port 68 remains exposed to the liquid flow in valve 66 even during shut-off, so that a small amount of liquid is bled to and through the manifolding recess 36, assuring that the dispensing system will be full of liquid and immediately ready to dispense as soon as the shoe returns to its normal axial position.

In the preferred embodiment shown, the shoe 30 is mounted for axial and non-rotational displacement along the fixed shaft 18. To this end, a cylindrical sleeve member 32 having bushings mounted in both terminal ends is axially and slidably retained on the shaft 18 and rotational displacement prevented by means of the key 42 riding in key slot **18*a* of the fixed shaft 18. The sleeve member 32 has in addition an upper vertically-extending tang member 32*a* having at its outermost terminal end a bifurcated portion that engages and retains the valve spool 124. In addition, the cylindrical sleeve member has a lower depending rectangular block member 32*b*, containing suitable cavities for the retention of spring members 46 and 48. The compression of the springs between the shoe 30 and the inner surface of the flange 16 may be adjusted by adjustment means shown, mounted on the upper surface of the block member 32*b*. The block member also has two vertically-extending bores for the slidable retention of two tie bars whose upper terminal ends are pivotally secured to the cam actuators 140 and 142 and whose lower terminal ends extend into mating bores in the shoe 30. The shoe 30** is fixedly secured to the tie bars by means of two quick-release pins.

Centrally located and axially aligned with shaft 18 on the block **32*b* there is carried a forwardly extending tang 31 for pivotal connection, by means of a clevis, to the actuator of the ram 108 which, when actuated, moves the sleeve member 32, tang 32*a*, block 32*b*, and shoe 30 axially along shaft 18**.

Handles 134 and 136 are carried on the block **32*b* for manual removal and replacement of the elements just described, assuming that the cam actuators 140 and 142 have been operated to withdraw the shoe 30 from band 16**, and various hoses, the ram, and the spool valve have been disconnected.

While the invention has been described with particular reference to specific embodiments in the interest of complete definiteness, it will be understood that it may be embodied in a large variety of forms diverse from those specifically shown and described without departing from the spirit and scope of the invention as defined by the appended claims.

What is claimed is:

1. A system for dispensing a liquid product into uniformly spaced-apart open-topped containers moving in a train along a predetermined path, comprising:

means for moving said containers in a train along a predetermined path;

a circular band positioned above said train and rotatable about an axis normal to the portion of said path beneath it;

said band having nozzle openings extending through it and circumferentially spaced from each other about said band;

means for supplying liquid product under pressure sequentially to said nozzles as they rotate with said band, so that said nozzles sequentially eject a stream of said liquid product;

means for rotating said band in synchronization with the motion of said containers so that each nozzle opening and its associated stream of liquid product is directed toward the top opening of a particular container as it passes along said path adjacent said band; and stream control means for initiating said stream through each of said nozzle openings when said each opening and its stream is directed at a predetermined first angle with respect to the vertical, and for terminating said last-named stream when said nozzle opening is at a predetermined second angle with respect to the vertical;

wherein said stream control means comprises a pressure shoe having a liquid-manifolding recess in its surface, sealing means extending around said recess, and means urging said shoe toward said band so that said sealing means engages said band, said recess normally being circumferentially aligned with said nozzle openings and having a circumferential length such that each of said nozzle openings first communicates with said recess when said each nozzle opening is at said first angle and terminates such communication when said nozzle opening is at said second angle;

said system also comprising means positioned adjacent said path for sensing the absence of one of said containers from said train to produce a control signal indicative of such absence; and shut-off means responsive to said control signal to move said shoe axially, out of circumferential alignment with said nozzle openings.

2. The system of claim 1, wherein said means for supplying liquid product comprises a positive displacement pump synchronized with the rotation of said band for pumping a predetermined amount of said liquid product into said recess during each traversal of each nozzle opening past said recess.

3. The system of claim 1, comprising a supply line for supplying said liquid product from said pump to said recess, a return line, and normally-closed valve means connecting said supply line to said return line, whereby when said shut-off means operates to block flow from said recess, said valve means opens to convey said liquid product to said return line at such times.

4. The system of claim 1, wherein said band is mounted on a circular plate for rotation about a central axis therein.

5. The system of claim 1, wherein said stream control means comprises a pressure shoe having a liquid-manifolding recess in its surface, sealing means extending around said recess, and means urging said shoe toward said band so that said sealing means engages said band, said recess normally being circumferentially aligned with said nozzle openings and having a circumferential length such that each of said nozzle openings first communicates with said recess when said each nozzle opening is at said first angle and terminates such communication when said nozzle opening is at said second angle, and an additional recess in the surface of said shoe, circumferentially aligned so as to communicate with each of said nozzle openings just after each nozzle opening has ceased communicating with the preceding liquid-manifolding recess, and means for applying gas under pressure to said additional recess to blow out each of said nozzles immediately after it has delivered its stream of liquid product to a container.

6. Apparatus for dispensing a liquid product into open-topped containers moving in a train along a predetermined path, comprising:

a circular band mounted for rotation about its central axis and having a plurality of nozzle openings extending through it at positions circumferentially spaced-apart along said band;

a pressure shoe fixable in position with respect to said band and having a liquid-manifolding recess in a surface thereof, the periphery of said recess bearing sealingly against a surface of said band so that as said band rotates about said axis, successive nozzle openings traverse and communicate with said recess and are supplied with liquid product from said recess during each such traversal; and shut-off means for moving said pressure shoe axially with respect to said band, to and from a shut-off position in which said nozzle openings do not communicate with said recess.

7. The apparatus of claim 6, comprising means for supplying said liquid product to said recess and means for controlling the rate at which said liquid product flows from said nozzle openings when said openings are aligned with said recess.

8. The apparatus of claim 6, comprising means for controlling the rate of rotation of said band so that the number of traversals of said recess by said opening per minute equals the number of said containers passing adjacent said apparatus per minute, and means for controlling the phase of rotation of said band so that said liquid product dispensed from each nozzle during each revolution of said band is received by a particular corresponding one of said containers.

9. The apparatus of claim 6, comprising means for spring-biasing said shoe toward said band to maintain said sealing engagement.

10. The apparatus of claim 6, wherein said shut-off means comprises means for producing a control signal indicative of the absence of a container from said train, and means for operating said shut-off means in response to said control signal upon the occurrence of each such absence.

11. The apparatus of claim 6, comprising pump means synchronized with the rotation of said band for delivering a flow of said liquid product to said recess in said shoe when said liquid product is to be dispensed through one of said nozzle openings, valve means, and a diversion line connected to said valve means, said valve means being responsive to said axial motion of said shoe to divert said liquid flow primarily into said diversion line when said shut-off means reduces such flow through a nozzle opening.

12. Apparatus for dispensing a liquid product into open-topped containers moving in a train along a predetermined path, comprising:

a circular band mounted for rotation about its central axis and having a plurality of nozzle openings extending through it at positions circumferentially spaced-apart along said band;

a pressure shoe fixable in position with respect to said band and having a liquid-manifolding recess in a surface thereof, the periphery of said recess bearing sealingly against a surface of said band so that as said band rotates about said axis, successive nozzle openings traverse and communicate with said recess and are supplied with liquid product from said recess during each such traversal; and an air blow-out recess in a surface of said band, normally in circumferential alignment with said nozzle openings, and positioned adjacent but spaced from said liquid-storing recess along the direction of traversal by said nozzle openings, the periphery of said blow-out recess sealingly engaging said band, whereby an air blast may be delivered to each of said nozzles to clear it of liquid product after it completes its dispensing operation.

* * * * *